US011114800B2

(12) United States Patent
Song

(10) Patent No.: US 11,114,800 B2
(45) Date of Patent: Sep. 7, 2021

(54) RELEASE WITH TAB AND CONNECTOR

(71) Applicant: Dongguan Luxshare Technologies Co., Ltd, Dongguan (CN)

(72) Inventor: Tao Song, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 16/809,296

(22) Filed: Mar. 4, 2020

(65) Prior Publication Data

US 2021/0021084 A1 Jan. 21, 2021

(30) Foreign Application Priority Data

Jul. 16, 2019 (CN) ..... 201910640228.X

(51) Int. Cl.
*H01R 13/633* (2006.01)
*H01R 13/627* (2006.01)

(52) U.S. Cl.
CPC ..... *H01R 13/6335* (2013.01); *H01R 13/6275* (2013.01)

(58) Field of Classification Search
CPC ..... H01R 13/6335; H01R 13/6275; H01R 24/64; H01R 2107/00; H01R 13/633; H01R 13/639
See application file for complete search history.

(56) References Cited

U.S. PATENT DOCUMENTS 4,805,742 A * 2/1989 Sato ..... B62L 1/12 188/24.11
6,416,353 B1 * 7/2002 Hwang ..... H01R 13/6335 439/484
8,056,682 B2 * 11/2011 Lin ..... B62L 1/16 188/24.12
8,571,375 B1 * 10/2013 Kyi ..... G02B 6/4284 385/134
2007/0093097 A1 * 4/2007 Guan ..... H01R 13/6335 439/157

(Continued)

FOREIGN PATENT DOCUMENTS

CN 205070027 U 3/2016
CN 205178149 U 4/2016

(Continued)

*Primary Examiner* — Truc T Nguyen
(74) *Attorney, Agent, or Firm* — Birch, Stewart, Kolasch & Birch, LLP

(57) ABSTRACT

The present disclosure disclosed a release with tab and a connector. The release with tab is disposed on a connector head. The release with tab comprises an elastic clip and a tab assembly. The elastic clip comprises a first chuck part, a second chuck part and an elastic part disposed on the connector head. The first chuck part is pivotally connected to the second chuck part. The elastic part is disposed between the first chuck part and the second chuck part. One end of the tab assembly is disposed on the elastic clip. The tab assembly moves in a direction away from the elastic clip to compress the elastic part and the tab assembly drives one end of the first chuck part to approach one end of the second chuck part. When the tab assembly is no longer subjected to external force, the tab assembly restores to the initial position.

15 Claims, 6 Drawing Sheets

(56) References Cited

U.S. PATENT DOCUMENTS

| | | | | |
|---|---|---|---|---|
| 2010/0230215 | A1* | 9/2010 | Ginster | B60T 11/046 188/24.22 |
| 2011/0294334 | A1* | 12/2011 | Phillips | G02B 6/4201 439/357 |
| 2012/0040552 | A1* | 2/2012 | Wu | H01R 13/6581 439/358 |
| 2012/0064750 | A1* | 3/2012 | Wu | H01R 13/6335 439/345 |
| 2012/0251049 | A1* | 10/2012 | Meadowcroft | G02B 6/4261 385/53 |
| 2012/0329305 | A1* | 12/2012 | Ritter | H01R 13/6335 439/350 |
| 2014/0179143 | A1* | 6/2014 | Kappla | H01R 13/665 439/310 |
| 2015/0280384 | A1* | 10/2015 | Leimbach | H01R 39/08 227/175.1 |
| 2016/0126647 | A1* | 5/2016 | Sunaga | H01R 12/721 439/76.1 |
| 2016/0220249 | A1* | 8/2016 | Shelton, IV | A61B 17/105 |
| 2017/0031109 | A1* | 2/2017 | Meadowcroft | G02B 6/387 |
| 2018/0138635 | A1* | 5/2018 | Henry | H01R 13/6335 |
| 2019/0258012 | A1* | 8/2019 | Hino | G02B 6/4278 |
| 2020/0194932 | A1* | 6/2020 | Henry | H01R 13/6275 |

FOREIGN PATENT DOCUMENTS

| | | | |
|---|---|---|---|
| CN | 205417246 | U | 8/2016 |
| CN | 205724200 | U | 11/2016 |
| CN | 206480864 | U | 9/2017 |
| CN | 107863637 | A | 3/2018 |
| CN | 108808345 | A | 11/2018 |
| CN | 209001173 | U | 6/2019 |
| TW | 201324973 | A1 | 6/2013 |
| TW | I597903 | B | 9/2017 |

* cited by examiner

RELEASE WITH TAB AND CONNECTOR

This application claims the priority benefit of Chinese Patent Application Serial Number 201910640228.X, filed on Jul. 16, 2019, the full disclosure of which is incorporated herein by reference.

BACKGROUND

Technical Field

The present disclosure relates to the technical field of a release and a connector, particularly to a release with tab and a connector.

Related Art

The existing latching components of connector heads are mostly released or latched by hand. Typically a latching component to be pressed to latch or to release is configured on the side of the connector head. Since the pressing component is configured above the connector head, it is required to leave sufficient space for fingers to press when the connector head is inserted into the socket. This results in a restriction of the components configuration, which is not conducive to the miniaturization and thinning of products.

SUMMARY

In the prior art, the latching component of the connector head is released or latched by hand, resulting a restriction of the components configuration and the inconvenience of use as there must be enough space for fingers to press above the connector head.

In one embodiment, the present disclosure provides a release with tab disposed on the connector head, comprising an elastic clip and a tab assembly. The elastic clip comprises a first chuck part, a second chuck part and an elastic part disposed on a connector head, where the first chuck part is pivotally connected to the second chuck part and the elastic part is disposed between the first chuck part and the second chuck part. One end of the tab assembly is disposed on the elastic clip, wherein the tab assembly moves in a direction away from the elastic clip to compress the elastic part and the tab assembly drives one end of the first chuck part to approach one end of the second chuck part.

In another embodiment, the present disclosure provides a connector, comprising a connector head, and the release with tab and a socket according to the first aspect. The connector head comprises a plug. The release according to the first aspect comprises an elastic clip disposed on the plug. The socket comprises a slot and a latching groove, wherein the slot is interconnected with the latching slot and the locking groove is disposed on the slot. The plug is inserted into the slot and the elastic clip is secured in the locking groove.

The problems or disadvantages of the prior art are improved by the release with tab and the connector disclosed in the present application. By way of design the elastic clip structurally configured with the tab assembly, users can simply pull the tab to release the elastic clip. With a great degree of flexibility, the tab may be simply pulled away from the connector head, then the connector head can be released by the tab acting on the elastic clip. The embodiments facilitate the release with the tab and increase the flexibility. Therefore, there are fewer difficulties in using the tab due to the configuration or structural relationships.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
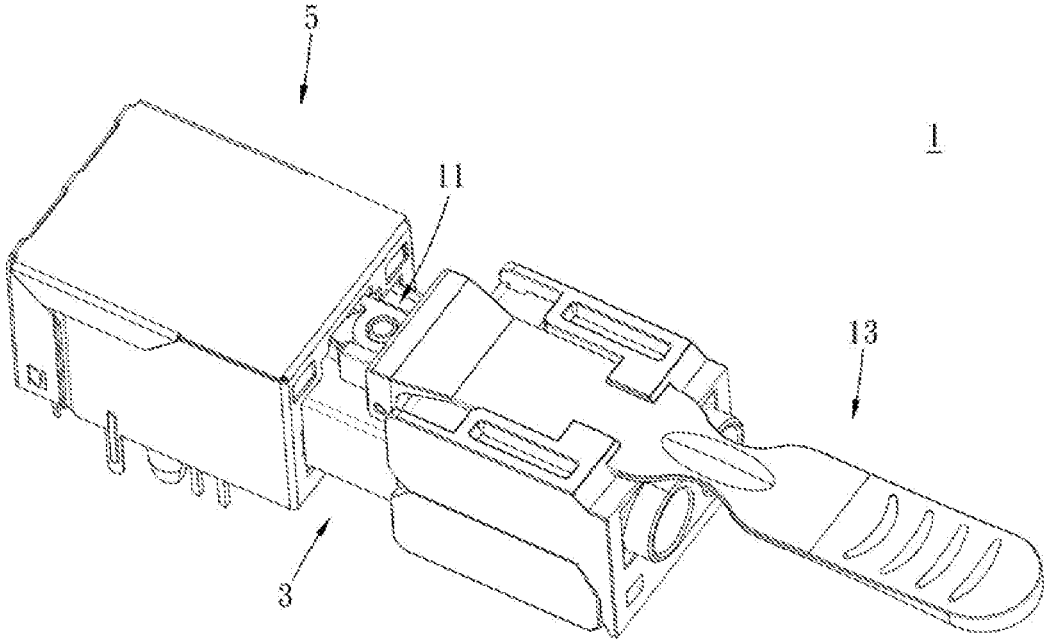
FIG. 1 is a perspective view of the connector of the present disclosure.

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the invention.

FIG. 1 is a perspective view of the connector of the present disclosure. A shown in the figure, the present disclosure provides a release with tab 1 securing an electrical connector head at one end of an electrical connecting cable to a latching assembly of an electrical socket. That is, the electrical connector head is interlocked with the electrical socket. In the present embodiment, the release with tab comprises an elastic clip 11 and a tab assembly 13.

Figure 2:
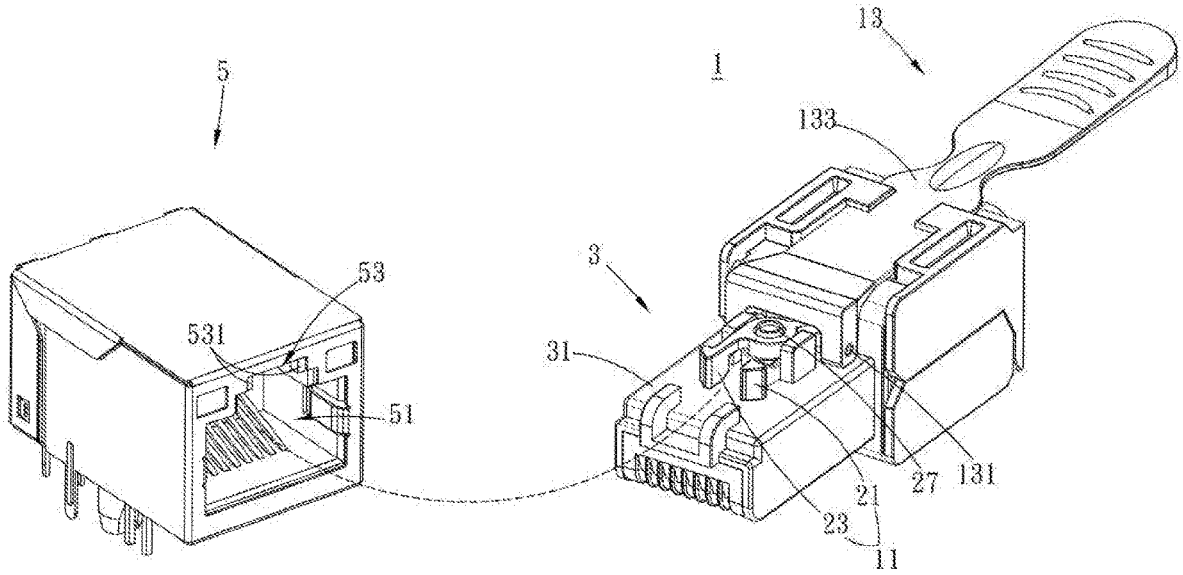
FIG. 2 is an exploded perspective view of the connector of the present disclosure.

FIG. 2 is an exploded perspective view of the connector of the present disclosure. As shown in the figure, in the present embodiment, the connector head 3 is a plug-type component at one end of a connecting cable. The specifications and types of the connector head 3 are not being limited in the present disclosure, and they could be various types of connection cables such as a network data line or a signal line. According to the requirements of the users, the connector head 3 shown in the present application is exemplified by an RJ45 network data cable connector, and the connector head 3 is plugged into a corresponding socket 5. In the embodiment of the present disclosure, the release with tab 1 is disposed on the connector head 3. The release with tab 1 is an interlocking component for the connector head 3 to be plugged into the socket 5.

Figure 3:
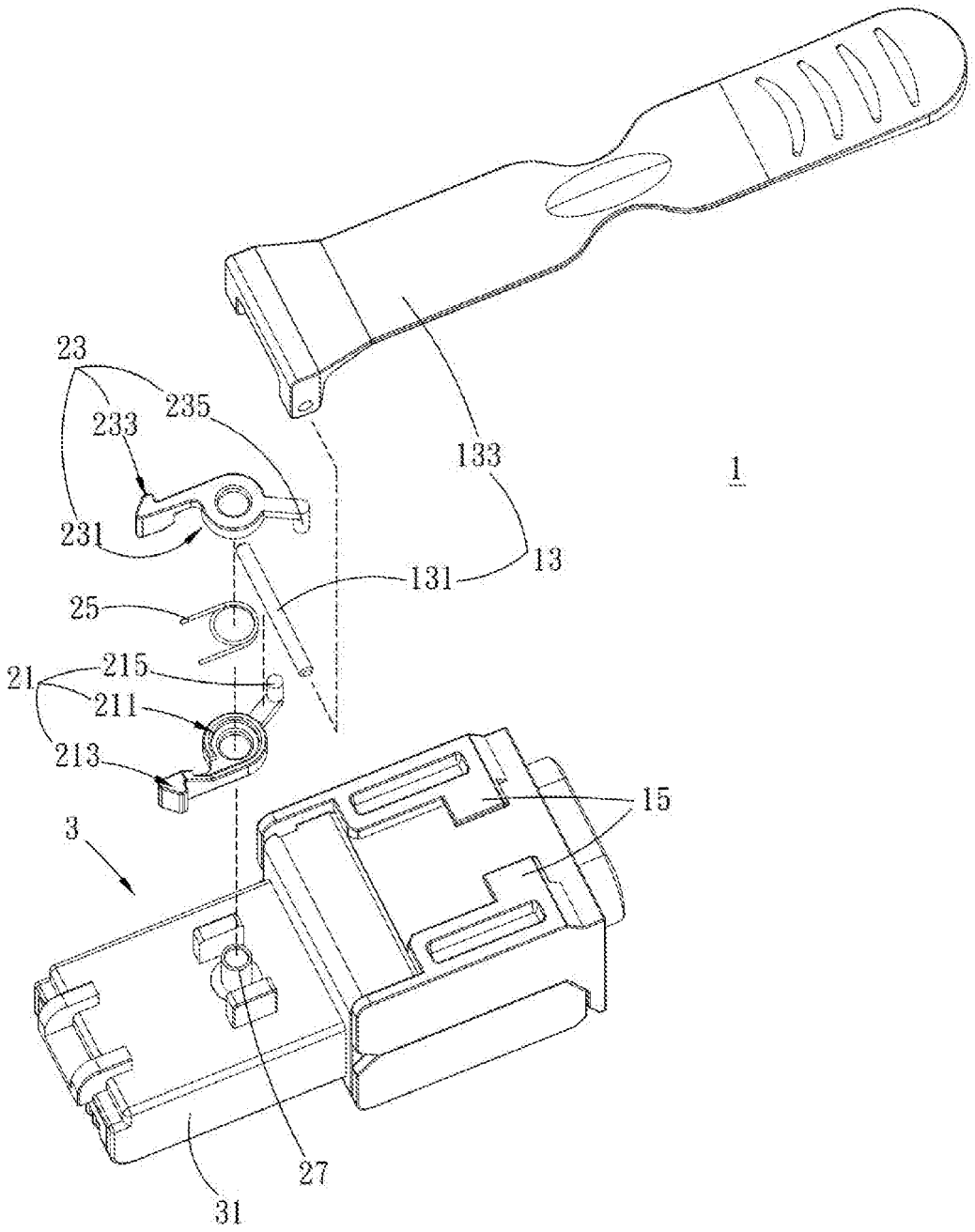
FIG. 3 is an exploded schematic diagram of the release with tab of the present disclosure.

FIG. 3 is an exploded schematic diagram of the release with tab of the present disclosure. As shown in the figure, the elastic clip 11 comprises a first chuck part 21, a second chuck part 23 and an elastic part 25 disposed on the connector head 3. The connector head 3 comprises a pivot cylinder 27 passing through the first chuck part 21 and the second chuck part 23. The first chuck part 21 is pivotally connected to the second chuck part 23, and the first chuck part 21 is interlaced with the second chuck part 23. The first chuck part 21 comprises a first clamping recess 211, and the second chuck part 23 comprises a second clamping recess 231, and the first clamping recess 211 corresponds to the second clamping slot 231. The first clamping recess 211 is structurally identical to the second clamping recess 231. The elastic part 25 is disposed in the space formed by the first clamping recess 211 and the second clamping recess 231. The elastic part 25 is a torsional spring. One end of the elastic part 25 abuts against the recess wall of the first clamping recess 211 and is adjacent to one end of the first chuck part 21; the other end of the elastic part 25 abuts against the recess wall of the second clamping recess 231 and is adjacent to one end of the second chuck part 23. Thus, the interval between one end of the first chuck part 21 and one end of the second chuck part 23 can be maintained at a fixed distance. Furthermore, one end of the first chuck part 21 comprises a hook part 213, and one end of the second chuck part 23 has a hook part 233. The hook of the hook part 213 of the first chuck part 21 and the hook of the hook part 233 of the second chuck part 23 oppositely protrude toward the outer side of the elastic clip 11, respectively.

Moreover, the tab assembly 13 comprises a shaft 131 and a tab 133. The shaft 131 is disposed at the other end of the first chuck part 21 and the other end of the second chuck part 23. The tab 133 is connected to the shaft 131. Wherein the other end of the first chuck part 21 comprises a protrusion 215 and the other end of the second chuck part 23 comprise a protrusion 235, wherein the two protrusions 215 and 235 are moving in an opposite direction. A space for securing is formed in between the pivoting of first chuck part with the second chuck part and the two protrusions 215 and 235. The shaft 131 passes through the space. That is, the shaft 131 is disposed in between the pivoting of the first chuck part 21 and the second chuck part 23 and the two protrusions 215 and 235. The tab is connected to both ends of the shaft 131.

In addition, the release with tab 1 further comprises a limiting part 15 disposed on the connector head 3. The limiting part 15 is disposed on the two sides above the connector head 3. The tab 133 passes through the space below the limiting part 15 and above the connector head 3. That is, the tab 133 is disposed between the limiting part 15 and the connector head 3. The limiting part 15 limits the pulling direction of the tab 133.

In the present embodiment, the socket 5 is used to connect the connector head 3 of the release with tab 1. The socket 5 comprises a slot 51 and a locking groove 53. The slot 51 is interconnected with the locking groove 53. The locking groove 53 is disposed on the slot 51. The inner wall of the locking groove 53 comprises bumps 531 (refer to FIG. 2) disposed on both sides of the inner wall of the locking groove 53. The elastic clip 11 is secured in the locking groove 53.

Figure 4:
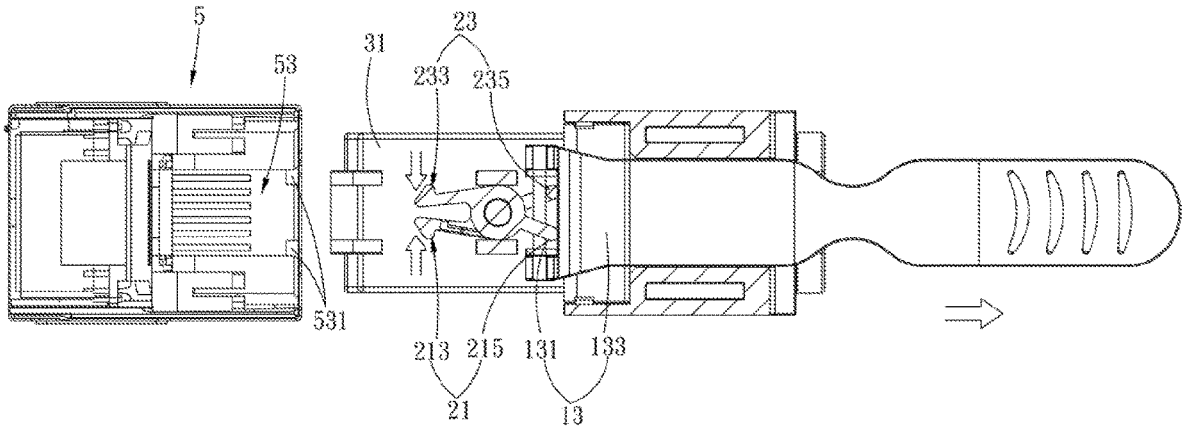
FIG. 4 is the first schematic diagram of the connecting actuation of the connector of the present disclosure.
Figure 5:
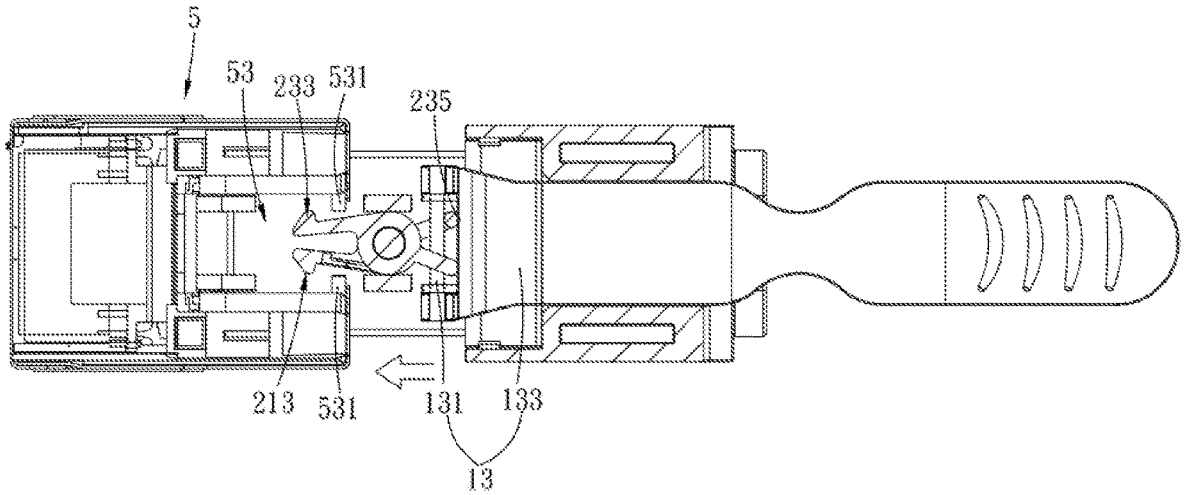
FIG. 5 is the second schematic diagram of the connecting actuation of the connector of the present disclosure.
Figure 6:
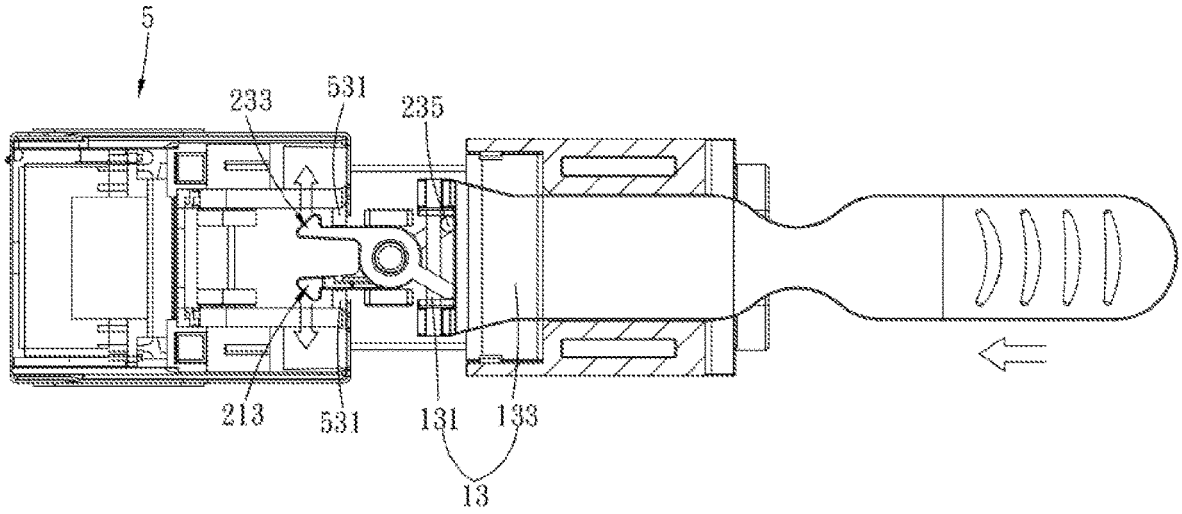
FIG. 6 is the third schematic diagram of the connecting actuation of the connector of the present disclosure.

FIG. 4 to FIG. 6 are the schematic diagrams of the connecting actuation of the connector of the present disclosure. As shown in the figures, in the present embodiment, the connector head 3 comprises a plug 31. The release with tab 1 comprises an elastic clip 11 disposed on the plug 31. Inserting the connector head 3 with the release with tab 1 into the socket 5, wherein the plug 31 is inserted into the slot 51 and the elastic clip 11 is secured in the locking groove 53. In the present embodiment, the tab 133 moves toward the direction away from the elastic clip 11. The tab 133 is limited by the limiting part 15, making the direction the tab 133 moves away from the elastic clip 11 is horizontal.

The shaft 131 moves with the tab 133 in the same direction, and the shaft 131 pushes the protrusion 215 of the first chuck part 21 and the protrusion 235 of the second chuck part 23 to move the protrusions 215 and 235 toward the pulling direction and the center position of the two protrusions. Thus, the protrusion 215 of the first chuck part 21 and the protrusion 235 of the second chuck part 23 are brought close to each other, and the elastic part 25 between the first chuck part 21 and the second chuck part 23 is pressed. At the same time, the hook part 213 of the first chuck part 21 and the hook part 233 of the second chuck part 23 are brought close to each other, making the distance between the hook part 213 of the first chuck part 21 and the hook part 233 of the second chuck part 23 is equal to or smaller than the distance between the two bumps 531 of the inner wall of the locking groove 53 (refer to FIG. 4).

Keeping the state in which the tab 133 pulls the release with tab 1 to enable the plug 31 with the elastic clip 11 to be inserted into the slot 51 with the latching groove 53, also, the release with tab is inserted into the locking groove 53 (refer to FIG. 6). The connector head 3 comprising the release with tab 1 is then interlocked to the socket 5.

When the connector head 3 comprising the release with tab 1 is connected to the socket 5, the pulling force on the tab assembly 13 can be released, and the compressed elastic part 25 is also released to the original status. The hook part 213 of the first chuck part 21 of the elastic clip 11 and the hook part 233 of the second chuck part 23 move away from each other and back to the initial position. The hook part 213 of the first chuck part 21 and the hook part 233 of the second chuck part 23 are locked with the two protrusions 531 of the inner wall of the latching groove 53. That is, the elastic clip 11 cannot directly exit the locking groove 53, and the elastic clip 11 is securely locked with the locking groove 53. In addition, the elastic clip 11 also actuates with the movement of the shaft 131. The shaft 131 draws the tab 133 toward the elastic clip 11 and back to the initial position of the tab 133. Thus, the locking of the connector head 3 comprising the release with tab 1 and the socket 5 is then completed.

On the contrary, to release the connector head 3 comprising the release with tab 1 from the socket 5, pull the tab 133 to make the distance between the hook part 213 of the first chuck part 21 and the hook part 233 of the second chuck part 23 is equal to or smaller than the distance between the two bumps 531 of the inner wall of the locking groove 53. The hook part 213 of the first chuck part 21 and the hook part 233 of the second chuck part 23 are no longer limited by the two protrusions 531 of the inner wall of the locking groove 53, so that the connector head 3 comprising the release with tab 1 can be smoothly pulled out of the socket 5.

In summary, the present invention proposed a release with tab and a connector. To improve the configuration of the locking mechanism of the prior art will cause limitation and inconvenience in use. The elastic clip with tab assembly of the present disclosure makes it easy for the users to release the elastic clip with tab. With great flexibility of the tab, simply release the lock by pulling the tab away from the end of the connector head of the cable in which the tab acts on the direction of the elastic clip. Therefore, tab with high flexibility facilitates the release with tab, and there will be no restrictions on use and operations due to configuration of the components.

It is to be understood that the term "comprises", "comprising", or any other variants thereof, is intended to encompass a non-exclusive inclusion, such that a process, method, article, or device of a series of elements not only include those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. A release disposed on a connector head, comprising:

an elastic clip comprising a first chuck part, a second chuck part, and an elastic part disposed on the connector head, wherein the first chuck part is directly pivotally connected to the second chuck part, and the elastic part is disposed between the first chuck part and the second chuck part; and a tab assembly, one end of which is disposed on the elastic clip, wherein the tab assembly moves in a direction away from the elastic clip to compress the elastic part and the tab assembly drives one end of the first chuck part to approach one end of the second chuck part, wherein the tab assembly comprises a shaft and a tab, the shaft is disposed at the other end of the first chuck part and the other end of the second chuck part, and the tab is connected to the shaft, so that the first chuck part and the second chuck part are pushed by the shaft to compress the elastic part and make the one end of the first chuck part approach the one end of the second chuck part when the tab moves in the direction away from the elastic clip to make the shaft move with the tab.

2. The release according to claim 1, wherein the first chuck part is interlaced with the second chuck part.

3. The release according to claim 1, wherein one end of the first chuck part and one end of the second chuck part respectively comprise a hook part; the hook of the hook part of the first chuck part and the hook of the hook part of the second chuck part oppositely protrude toward the outer side of the elastic clip, respectively.

4. The release according to claim 1, wherein the other end of the first chuck part comprises a protrusion and the other of the second chuck part comprises another protrusion, wherein the two protrusions are moving in a opposite direction; a space for securing is formed in between the first chuck part, the second chuck part, and the two protrusions; the shaft passes through in the space; the tab is connected to both ends of the shaft.

5. The release according to claim 1, comprising:

a limiting part;

wherein the limiting part is disposed on the connector head, and the tab is disposed between the limiting part and the connector head.

6. The release according to claim 1, wherein the connector head comprises a pivot cylinder; the pivot cylinder passes through the first chuck part and the second chuck part.

7. The release according to claim 1, wherein the elastic part is a torsional spring.

8. A connector, comprising:

the connector head, comprising a plug;

the release according to claim 1, wherein the release comprises the elastic clip; the elastic clip is disposed on the plug; and a socket, comprising a slot and a locking groove; the slot is interconnected with the locking groove; the locking groove is disposed on the slot;

wherein the plug is inserted into the slot; the elastic clip is secured in the locking groove.

9. The connector according to claim 8, wherein an inner wall of the locking groove comprises two bumps; the hook of the hook part of one end of the first chuck part and the hook of the hook part of the second chuck part are secured to the bumps in the locking groove.

10. A connector, comprising:

the connector head, comprising a plug;

the release according to claim 2, wherein the release comprises the elastic clip; the elastic clip is disposed on the plug; and a socket, comprising a slot and a locking groove; the slot is interconnected with the locking groove; the locking groove is disposed on the slot;

wherein the plug is inserted into the slot; the elastic clip is secured in the locking groove.

11. A connector, comprising:

the connector head, comprising a plug;

the release according to claim 3, wherein the release comprises the elastic clip; the elastic clip is disposed on the plug; and a socket, comprising a slot and a locking groove; the slot is interconnected with the locking groove; the locking groove is disposed on the slot;

wherein the plug is inserted into the slot; the elastic clip is secured in the locking groove.

12. A connector, comprising:

the connector head, comprising a plug;

the release according to claim 4, wherein the release comprises the elastic clip; the elastic clip is disposed on the plug; and a socket, comprising a slot and a locking groove; the slot is interconnected with the locking groove; the locking groove is disposed on the slot;

wherein the plug is inserted into the slot; the elastic clip is secured in the locking groove.

13. A connector, comprising:

the connector head, comprising a plug;

the release according to claim 5, wherein the release comprises the elastic clip; the elastic clip is disposed on the plug; and a socket, comprising a slot and a locking groove; the slot is interconnected with the locking groove; the locking groove is disposed on the slot;

wherein the plug is inserted into the slot; the elastic clip is secured in the locking groove.

14. A connector, comprising:

the connector head, comprising a plug;

the release according to claim 6, wherein the release comprises the elastic clip; the elastic clip is disposed on the plug; and a socket, comprising a slot and a locking groove; the slot is interconnected with the locking groove; the locking groove is disposed on the slot;

wherein the plug is inserted into the slot; the elastic clip is secured in the locking groove.

15. A connector, comprising:

the connector head, comprising a plug;

the release according to claim 7, wherein the release comprises the elastic clip; the elastic clip is disposed on the plug; and a socket, comprising a slot and a locking groove; the slot is interconnected with the locking groove; the locking groove is disposed on the slot;

wherein the plug is inserted into the slot; the elastic clip is secured in the locking groove.

* * * * *